United States Patent [19]

Merjan

[11] 3,984,992

[45] Oct. 12, 1976

[54] PILE DRIVING MANDREL

[76] Inventor: Stanley Merjan, 16 Beacon Drive, Port Washington, N.Y. 11050

[22] Filed: June 10, 1974

[21] Appl. No.: 478,028

[52] U.S. Cl. ..... 61/53.72; 242/72 R
[51] Int. Cl.[2] ..... E02D 7/30
[58] Field of Search ..... 61/53.72; 242/72

[56] References Cited

UNITED STATES PATENTS

| | | | |
|---|---|---|---|
| 2,871,666 | 2/1959 | Pickman | 61/53.72 |
| 3,007,318 | 11/1961 | Rusché | 61/53.72 |
| 3,064,439 | 11/1962 | Cobi | 61/53.72 |

*Primary Examiner*—Jacob Shapiro
*Attorney, Agent, or Firm*—Abner Sheffer

[57] ABSTRACT

An expansible pile driving mandrel made up of two arcuate segments, each having a chordal stiffening web and a hydraulic cylinder carried by the web of one segment and passing the web of the other.

3 Claims, 15 Drawing Figures

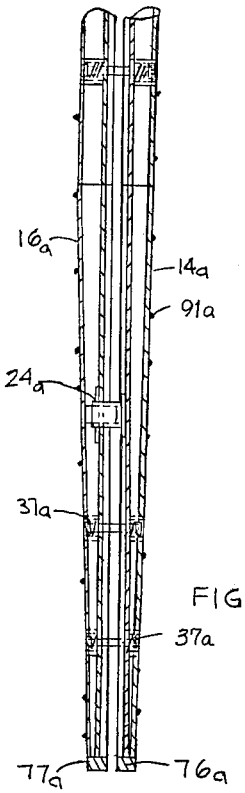
FIG. 11
FIG. 12
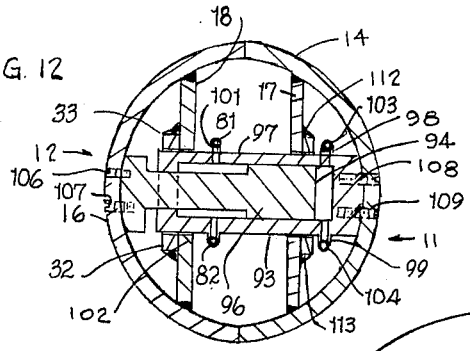
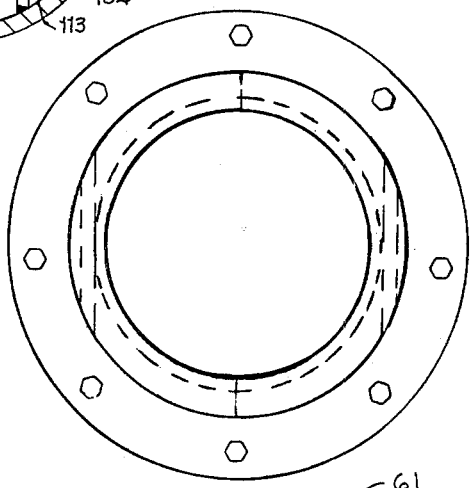
FIG. 14
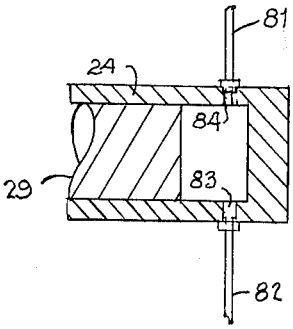
FIG. 15
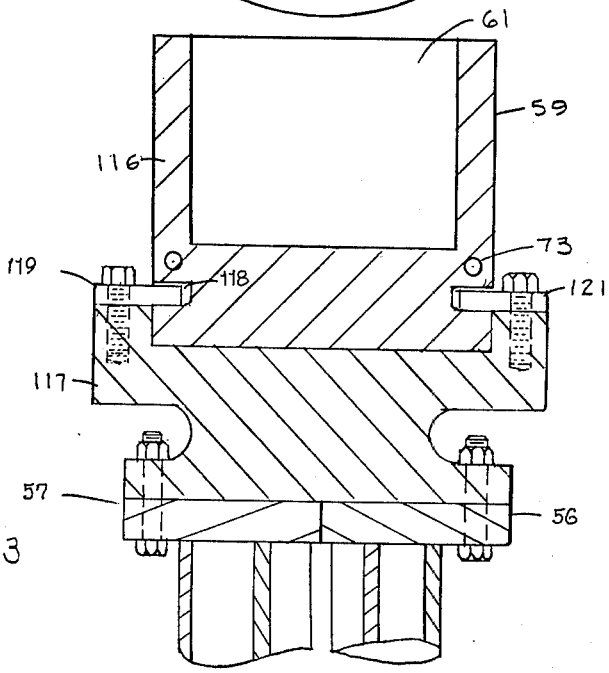
FIG. 13

PILE DRIVING MANDREL

Cylindrical shell piles are conventionally driven by the use of an expansible mandrel. A great many patents have been issued for such mandrels. The expansible mandrels in commercial use in the United States include the Hercules mechanically expansible mandrel, the Cobi and Candler-Rusche pneumatic mandrels and the Guild mandrel which uses an arrangement of cables, sheaves and pulleys that may be hydraulically actuated to expand the mandrel.

The commercial mandrels are not altogether satisfactory. Some are subject to all too frequent mechanical malfunctions resulting in "stuck cores", such as jamming of a mandrel in a driven shell, which requires dangerous and costly measures for extraction. Some do not grip the shell adequately under high driving stresses, or are subject to damage under such stresses (which damage may include bending or other distortion of the mandrel), or are subject to jamming of the retraction mechanism when a shell is ripped during driving and dirt enters around and into the mandrel.

In accordance with one aspect of this invention there is provided an extremely sturdy mandrel of simple construction, which is resistant to damage or distortion under high driving stresses, which grips the shell firmly, is resistant to jamming and is easy to clean and repair when necessary.

In one aspect of the invention the mandrel has two long segments of arcuate cross-section spanned by a stiffening web. One of the two segments carries spaced hydraulic cylinders which pass through the web of the other segment.

Certain embodiments of the invention are shown in the accompanying drawings in which FIG. 1 is a horizontal cross sectional view of a mandrel within the shell taken along the line 1—1 of FIG. 5;

FIGS. 2 and 3 are horizontal cross-sections of the same mandrel taken along lines 2—2 and 3—3, respectively of FIG. 5;

FIG. 11 is a vertical cross-sectional view of a mandrel having a tapered lower portion for use with a similarly tapered shell;

FIG. 12 is a horizontal cross-sectional view of a mandrel having a double acting hydraulic cylinder;

FIG. 13 is a vertical cross-sectional view of the upper part of a mandrel having a swivelling anvil attached thereto;

FIG. 14 is a plan view of FIG. 13;

FIG. 15 is a schematic view showing the ports and hoses of the hydraulic cylinder shown in FIG. 2.

Figure 1:
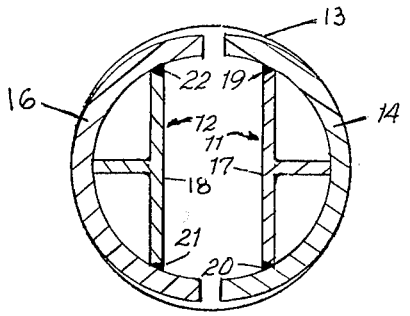

As indicated previously, the mandrel is made up of two long segments 11, 12. These are preferably kept together by spring forces. After the mandrel is inserted into the shell to be driven, the two segments are hydraulically pressed apart to bear against the inside of the shell 13 (FIG. 1). Then the pile driving hammer pounds down on the anvil atop the mandrel, which carries the shell down with it. When the shell has reached the desired bearing level (which may be determined by measuring the driving resistance, e.g. number of blows needed to drive the mandrel and shell downward some given distance) the hydraulic pressure is relieved, the two segments return to their retracted position under the influence of the associated springs, the mandrel is pulled out of the shell and the latter is filled with concrete.

The segments are preferably of arcuate cross section, each extending over an arc of greater than 100° measured from the center of the mandrel and each having a strong stiffening plate subtending an angle greater than 90° (again, measured from the center of the mandrel).

In the illustrated embodiment the segments are made from a heavy steel circular pipe by cutting the pipe lengthwise into two substantially equal halves, forming long channels 14, 16 of substantially semicircular cross section, and then welding a structural tee 17 or 18 symmetrically to the inside of each channel, the ends of the arms of the tee being welded to the inner walls of each channel, preferable along continuous rectilinear weld lines 19, 20, 21, 22. More specifically in the illustrated embodiment the outer perimeter of each channel extends over an arc of about 165° while the arms of the tee form a chord subtending an angle of about 120°, as measured in the position shown in FIG. 1.

Figure 2:
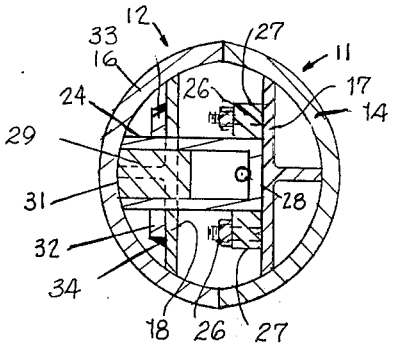
Figure 5:
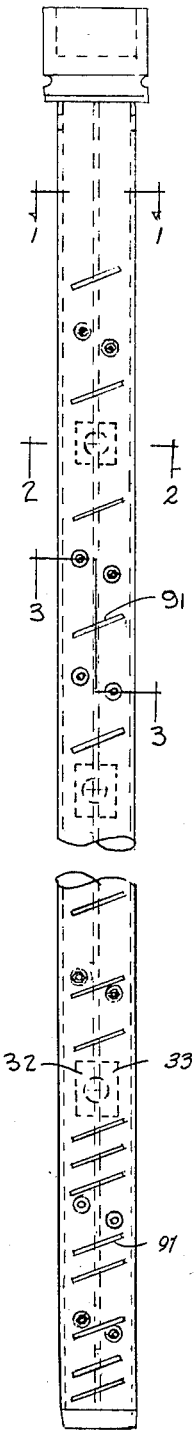
FIG. 5 is a view of the same mandrel in elevation.

The structural tee 18 in one channel 16 is cut out at spaced points along its length to receive hydraulic cylinders 24 (FIG. 2) which are secured to the structural tee 17 in the opposite channel 14 (as by means of studs 26 in an integral flange 27 welded to the end of each cylinder). The end wall 28 of each cylinder abuts against the tee 17 on which it is mounted, while the piston 29 within the cylinder is adapted to press against the inner wall of the opposite channel 16; preferably the outer end 31 of the piston is shaped (e.g. curved) to largely conform to the shape of said inner wall at that point, so as to distribute the force over the area of the piston end 31. To reinforce the tee 18 at each of the cutout portions a pair of plates 32, 33 (see also FIG. 5) is welded (preferably along the whole outer circumference of each plate, as shown at 34); this increases the effective thickness around the cut-outs and maintains the structural thickness in these zones. As shown in FIG. 2 each tee is composed of a stiffening plate (formed of the arms of the tee) and a stem; and the stem and plate of the tee 18 are cut out centrally of said plate to receive the hydraulic cylinders.

Figure 3:
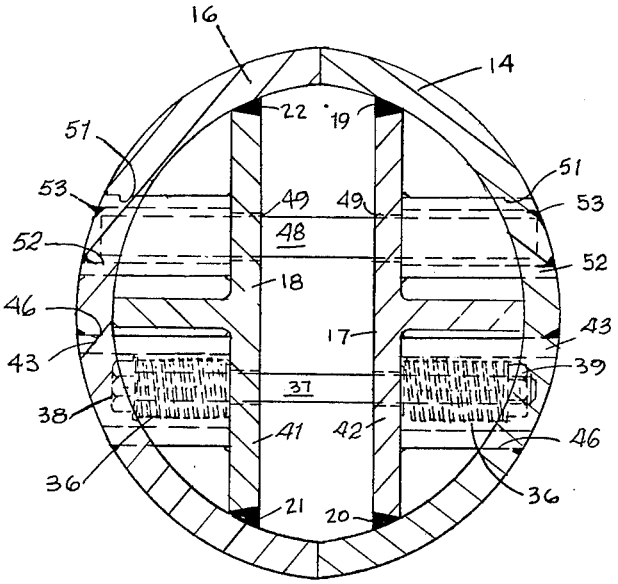

The two segments are kept pressed together by spring action, as previously noted. To this end a series of paired spaced helical springs 36 (FIG. 3) mounted on bolts 37 is distributed along the lengths of the segments, which are cut out (through the arms of the tee and through the channels) to receive them. Each spring is mounted for compression between a stop (either a bolt head 38 or a nut 39 threaded at the other end of the bolt) and the inner face of an arm 41 or 42 of a tee. Cylindrical rigid steel pockets 43 are preferably welded (at their ends, as shown in FIG. 3, to the arms of the tee and to the channels at the openings 46 in the latter. These reinforce and maintain the stiffness of the segments at the zones where they would otherwise be weakened by the openings therein. The presence of the pockets 43 may also help to maintain the bolts and springs in their proper alignment.

In one embodiment of the invention the mandrel may have one or more pairs of aligning pins 48. Here again the arms of the tees and the wall of the channel are cut out (at 49, 51 respectively, for instance) to receive the pins which housed in rigid steel pockets 52 welded (as shown in FIG. 3) to said arms and channel wall. Longitudinal sliding of the pins is limited by stops, such as weld beads 53 at the outer ends of the pockets 52. The pins 48 and hydraulic cylinders 24 may be subjected to shearing forces during the driving of the pile since the segments 11, 12 may not be always driven absolutely equally.

Figure 6:
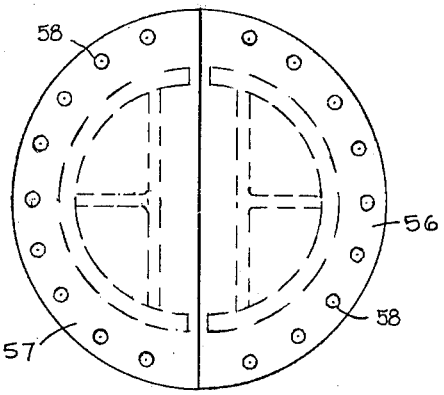
FIG. 6 is a plan view of the same mandrel showing the details of its upper part.
Figure 7:
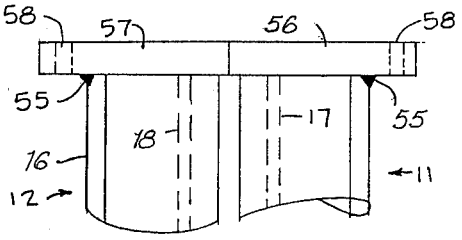
FIG. 7 is a view of the upper part of the same mandrel in elevation.
Figure 4:
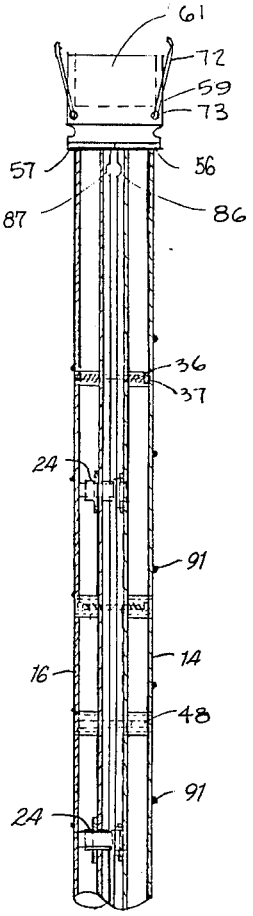
FIG. 4 is a vertical cross-sectional view of the same mandrel with an anvil shown at the top.
Figure 4:
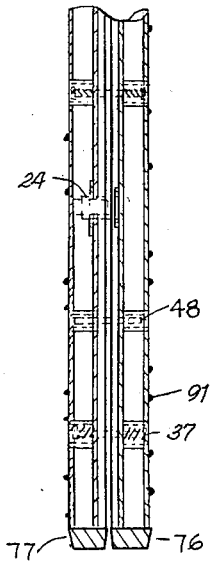

At the top of the mandrel each segment 11, 12 is suitably secured (as by welding at 55, FIG. 7) to a semi-circular flange or plate 56 or 57 (FIGS. 6 & 7) adapted to be attached (as by bolts passing through holes 58 therein) to the base of an anvil 59 (FIG. 4) which receives the blows of the pile driving hammer. The anvil 59 has a well 61 which may house a conventional cushion. The hammer (of conventional construction) has a base which rests on the top of the anvil 59, an upper portion joined to the base by rigid guide rods, and a ram (driven by steam, air, or other motive force) mounted for vertical reciprocating movement on said guide rods and having a ram tip which is mounted to pass through a central passage of the hammer base and strike the cushion in the well 61. The hammer base is suitably secured to the anvil 59; for instance it may be lashed thereto (in conventional fashion) by means of cables 72 (passing through holes 73 in the anvil) which permit only limited rotational movement (e.g. 10°–15° in a horizontal plane) of said anvil with respect to the hammer.

Figure 8:
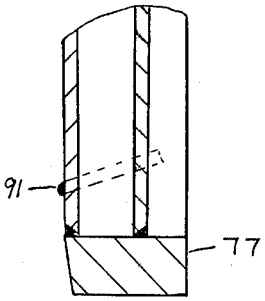
FIG. 8 is a view in cross-section of a portion of the lower part of the same mandrel.
Figure 9:
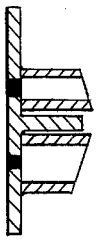
FIG. 9 is a horizontal cross-section of a reinforcing tee which is used in the mandrel, taken along a line to show also spring-and pin-receiving pockets welded thereto.

At the bottom, each segment is fitted with a tapered semicircular tip 76, 77 (FIGS. 4 and 8) welded to its channel and tee to make it easier to insert the mandrel into the shell to be driven.

In each pair thereof, the bolts 37 or pins 48 are in staggered relation along the length of the mandrel. In this way any net section, perpendicular to the stresses exerted on the mandrel, has, at most, only one cut-out portion rather than a pair of such portions. This helps to maintain the stiffness and strength of the structure. At the same time the elements of the pair are close enough to each other so that the spring system works substantially concentrically without creating a significant twisting couple.

Typically the holes to receive the pins will be, say, about 1 to 2 inches (e.g. 1⅜ inch) in diameter and the longitudinal spacing of the centers of the holes for a pair of pins will be say about 5 to 8 inches (e.g. 6 inches). Similarly the holes to receive the bolts will be, say, about ½ to 1½ inches (e.g. about ¾ inch) in diameter and the longitudinal spacing of the centers of the holes for a pair of bolts will be say about 5 to 8 inches (e.g. 6 inches).

The mandrel will generally have at least two hydraulic cylinders 24, spaced, say, about 3 to 15 feet (e.g. 8 feet) apart. The cylinders are connected through each other to the hydraulic pump (e.g. the master cylinder, not shown, at which the pressure in the hydraulic fluid system is applied) by flexible hydraulic hose. Thus each cylinder is connected by one hose 81 (FIG. 15) to the cylinder above it and by another hose 82 to the cylinder below it and each cylinder has two ports 83 and 84 for this purpose (except of course for the last cylinder of the series, which has only one open port). The hydraulic hose is flexible and is not subjected to any significant pull during the pile-driving operation. Each channel is cut away near the top (as at 86, 87 of FIG. 4) to provide a passage for the hose which extends down between the tees 17, 18.

As mentioned above, the channels 14, 16 may be made from a pipe (of circular cross section) by cutting the latter in half lengthwise. As illustrated in FIG. 1 the cut is preferably such that the cross section of each channel is not quite a semicircle, e.g. a band about 1 inch wide (½ inch of each long edge of each channel) may be removed. The external diameter of the pipe is preferably uniform along its length and slightly smaller than the internal diameter of the shell in which the mandrel is to be used. Preferably the outer surfaces of the channels have secured thereto spaced driving ridges 91 which may be of one-half round bar steel, welded to fit into the helically arranged corrugations of the shell.

The structural tees 17, 18 may be produced by cutting in half, longitudinally through its web, a conventional wide flange beam.

Figure 10:
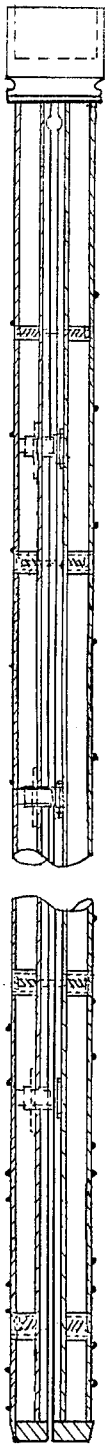
FIG. 10 is a view like that of FIG. 4 but showing a mandrel having no aligning pins.

In the embodiment shown in FIG. 10 no aligning pins are employed.

In the embodiment shown in FIG. 12 the hydraulic cylinder 93 is of the double-acting type, so that it serves not only to expand the mandrel but also to contract it. The larger face 94 of its piston 96 receives the mandrel-expanding fluid pressure while the smaller face 97 is exposed to the mandrel-contracting pressure, there being suitable ports 98, 99, 101, 102 hoses 81, 82 103, 104 connected (like the other hoses) to a selectively operated master cylinder (not shown). At the exposed end of the piston it is secured (as by means of screws 106, 107) to the inner wall of one of the channels, 16. In the embodiment illustrated in FIG. 12 the cylinder 93 is longer than the cylinder 24 shown in FIG. 2, and it passes through the tee 17 and is secured (as by means of screws 108, 109) to the inner wall of the channel 14. The tee 17 is cut out at spaced points to receive the cylinders 93 and is reinforced at each of the cut-out portions by a pair of plates 112, 113, which are welded thereto and which are identical in structure and function with the previously described plates 32, 33. Since in this embodiment there are ports and hoses in the interior of the segment 11, suitable openings are provided in one or both arms of tee 17 (preferably near the top of the mandrel) for passage of the hoses to the space between segments 11 and 12 and thus to the opening 86, 87.

The mandrel is generally at least 15 feet long. A typical basic length is about 40 feet; additional lengths (e.g. 8 feet lengths when the axial spacing between hydraulic cylinders is about 8 feet) may be welded onto the ends to make longer mandrels (e.g. 64 feet or 80 feet long) or such longer mandrels may be made from correspondingly long single channels. The thickness of the channel walls is preferably at least about ¾ inch (e.g. ¾ inch to 1½ inch) and the arms and stems of the tees are preferably at least about ½ inch thick (e.g. ½ to 1 inch such as ⅝ inch). The cylindrical pockets 43 and 52 are preferably sections of steel pipe having a wall thickness of at least about ⅜ inch. Typically the hydraulic cylinders are about 3 to 5 inches in outside diameter (e.g. 3¾ inch with a 2½ inch diameter piston). There is usually a small clearance (such as a total clearance of about 1/16 inch) around the cylinders, the bolts and the pins (the total clearance being the difference between outside diameter of the element and the inside diameter of the closest surrounding portion of the segment 11 or 12.)

The mandrels may be used with corrugated shells 13 ranging in internal diameter from about 10 inches upward such as about 12, 14, 16 or 18 inches or even larger. The external diameter of the mandrel is slightly less than the internal diameter of the shell except of course when the mandrel is expanded hydraulically. Thus, for a shell having an internal diameter of about 15⅛ inches (measured at the innermost points of the corrugations) one may employ a mandrel whose channels are made from pipe having an external diameter of 14 inches, the channels being fixed to form a full 14 inch diameter circle (except for the 1 inch cut previously mentioned) at the top, just below the anvil. There is some lengthwise flexibility in the segments, so that they are brought closer together at lower levels, below the anvil, by the actions of the springs, and can be forced apart by the action of the hydraulic cylinders so as to span substantially the full 15⅛ width (to which is added the heights of the driving ridges 91). For instance, the uppermost hydraulic cylinder may be, say, some ten feet below the flange or plate 56, so that the expansion of the cylinder to bring the outer portions of each channel into contact with the shell at the level of the cylinder will involve about ½ inch deflection of each channel in that 10 foot length.

When the mandrel is used to drive shell piles having enlarged tips, such as that disclosed in my U.S. Pat. No. 3,751,931 of Aug. 14, 1973, the shells do not tend to rotate significantly during the driving operation. When, however, more conventional shell piles are employed, the interaction of the helical corrugations (of the shell) with the ground tends to cause continued rotation of the shell about its axis. In the latter case, there is preferably a swivel connection (see FIGS. 13 and 14) between the upper and lower portions, 116, 117 respectively, of the anvil. Such swivel connection may comprise a circumferential groove 118 in said upper portion and a pair of plates 119, 121 (secured to said lower portion) which fit into said groove 118 and thus prevent separation of said upper and lower portions while permitting the latter to rotate with the shell.

As indicated in FIG. 11 the mandrel may also be constructed so as to taper along its length, or at the bottom portion thereof, to drive a correspondingly tapered shell, of conventional construction. In FIG. 11 the reference numerals have the suffix *a* and represent the same kinds of elements as those having the same numeral (except for said suffix) previously described.

As indicated previously, in a preferred embodiment of the invention the hydraulic cylinders are spaced several feet apart (e.g. at least about 5 feet apart) and their force is thus applied at spaced zones along the length of the mandrel.

The stell shell is typically helically corrugated and relatively thin. Typically its wall thickness is about 1/32 inch to 1/16 inch (such as 14, 16 or 18 U.S. Standard gage) its valleys are about ½ inch deep and its corrugations are about 2 inches wide (e.g. measured from one peak to the next). It is thus susceptible to expansion and contraction both radially and axially.

The mandrel of this invention is particularly adapted to withstand the action of high energy pile driving hammers such as those having energies of about 15,000 to 50,000 foot pounds per blow. The hydraulic pressures on the hydraulic fluid to expand the mandrel are typically in the range of about 2,000 to 10,000 psi, e.g. 3,000 or 5,000 psi. The expanding force exerted by each of the spaced cylinders is typically in the range of about 15,000 to 75,000 pounds, e.g. 20,000, 40,000 or 60,000.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

I claim:

1. In an expansible pile-driving mandrel for use with a pile shell whose walls are incapable of withstanding the pile-driving forces, said mandrel having means for receiving the pile-driving forces and having two opposed elongated segments adapted to be positioned lengthwise vertically within said shell and to be pressed transversely against the inside of said shell to transmit said pile driving forces to said shell, each of said two segments having an arcuate perimeter spanned by a stiffening plate, the improvement wherein one of said two segments carries a hydraulic cylinder which passes through said plate of the other of said two segments, said cylinder has means for connecting said cylinder to a source of pressurized fluid and has a piston for pressing against one of said segments to expand said mandrel, each of said segments comprises an arcuate channel and a tee integral therewith, the arms of said tee comprising said plate, the ends of the arms of said tee being integrally secured, by welding, to said channel and the stem of said tee serving to stiffen said plate and extending into contact with said channel, there is a portion cut out of said tee of said other segment to receive said cylinder, and there are reinforcing means to thicken and strengthen said plate around said cut out portion, there being a plurality of said cylinders spaced vertically, along the length of said mandrel, about 3 to 15 feet apart, said cylinders having outside diameters of about 3 to 5 inches and there being a small clearance between each cylinder and the surrounding portion of said stiffening plate through which said cylinder passes whereby said cylinders are subjected to shearing forces during pile driving when said segments are not driven equally.

2. A mandrel as in claim 1 in which said clearance is about one sixteenth inch, the thickness of the arms of said tees is about ½ inch to one inch, and said cylinders are spaced about 8 feet apart.

3. A mandrel as in claim 1 in which the arcuate perimeter of each segment is substantially semicircular and said stem and plate of said other segment are cut out centrally of said plate to receive said cylinders.

* * * * *